US011637379B2

(12) United States Patent
Judd

(10) Patent No.: US 11,637,379 B2
(45) Date of Patent: Apr. 25, 2023

(54) DECOUPLED INNER SLOT ANTENNA

(71) Applicant: Mano D. Judd, Heath, TX (US)

(72) Inventor: Mano D. Judd, Heath, TX (US)

(73) Assignee: Mano D. Judd, Heath, TX (US)

( * ) Notice: Subject to any disclaimer, the term of this patent is extended or adjusted under 35 U.S.C. 154(b) by 657 days.

(21) Appl. No.: 16/663,650

(22) Filed: Oct. 25, 2019

(65) Prior Publication Data

US 2021/0126375 A1 Apr. 29, 2021

(51) Int. Cl.

| | |
|---|---|
| ***H01Q 9/28*** | (2006.01) |
| ***H01Q 1/36*** | (2006.01) |
| ***H01Q 21/00*** | (2006.01) |

(52) U.S. Cl.

CPC ..... *H01Q 9/285* (2013.01); *H01Q 1/362* (2013.01); *H01Q 21/005* (2013.01)

(58) Field of Classification Search

CPC ..... H01Q 9/28; H01Q 1/36; H01Q 21/00

See application file for complete search history.

(56) References Cited

U.S. PATENT DOCUMENTS 7,061,442 B1 * 6/2006 Tang ..... H01Q 5/28 343/770

* cited by examiner

*Primary Examiner* — Andrea Lindgren Baltzell

(57) ABSTRACT

In the design of phased array antennas, as well as simple use of compact antennas, there is a strong interest to locate higher frequency antennas closer in spacing, and/or on the same surface, as the larger frequency antennas. What is needed is an array antenna technology, which can be conformal, and can interleave elements, as the frequency increases, to reduce array grating lobes. The desired solution would have much fewer required RF antenna ports, than the Tightly Coupled Dipole Antenna solutions. The optimal solution would also enable Dual or Diverse Polarization. This innovation embeds a wideband Slot Antenna, within the physical area of a larger electric dipole Antenna or Cross Dipole Antenna, with a De-Coupling gap around the Slot Ground Plane (or conductor) and isolates the Wideband Slot Antenna (the inner antenna) from the Dipole or Monopole antenna leg(s) (the Outer Antenna). Both (Inner and Outer) antennas have independent feeds and independent transmission line(s). Two key innovations are the use of a De-Coupling gap, and the use of the patent pending innovation "Compact Single Pole Wideband Slot Antenna Design with Inverted Co-Planar Waveguide Feed". Both the Inner Slot Antenna and its CPW feed are independent and isolated from the Outer Antenna and its feed and transmission line. This structure, which could have a multiplicity of inner Slot Antennas with numerous RF ports, is very different from the slot or parasitic inner structure within a single port antenna system.

14 Claims, 15 Drawing Sheets

Decoupled Inner Slot Monopole Antenna

E-Field of Outer Antenna

E-Field of Inner Antenna

| | |
|---|---|
| 100 | Outer Antenna Ground (conductor) |
| 105 | De-coupling Gap |
| 110 | Inner Antenna Slot (conductor) |
| 115 | Tuning Element |
| 125 | Slot (hole) |
| 130 | RF Connector at Inner Slot antenna feed |
| 135 | Monopole Ground Plane |
| 140 | Monopole Feed (source) |
| 150 | Slot Gap |
| 155 | Coplanar Wave Guide Transmission Line |

FIG 1: Decoupled Inner Slot Monopole Antenna
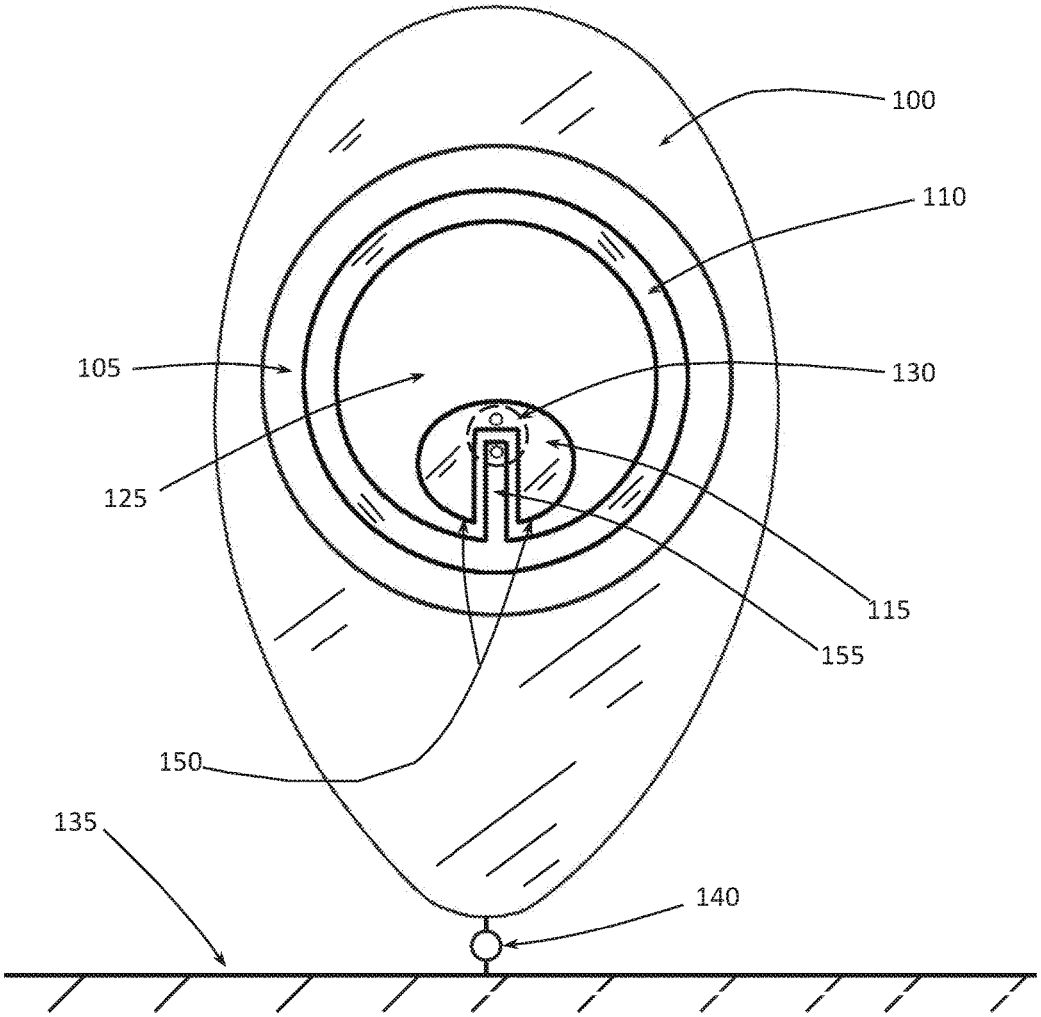
E-Field of Outer Antenna
E-Field of Inner Antenna
| | |
|---|---|
| 100 | Outer Antenna Ground (conductor) |
| 105 | De-coupling Gap |
| 110 | Inner Antenna Slot (conductor) |
| 115 | Tuning Element |
| 125 | Slot (hole) |
| 130 | RF Connector at Inner Slot antenna feed |
| 135 | Monopole Ground Plane |
| 140 | Monopole Feed (source) |
| 150 | Slot Gap |
| 155 | Coplanar Wave Guide Transmission Line |

FIG 2: Decoupled Inner Slot Dipole Antenna
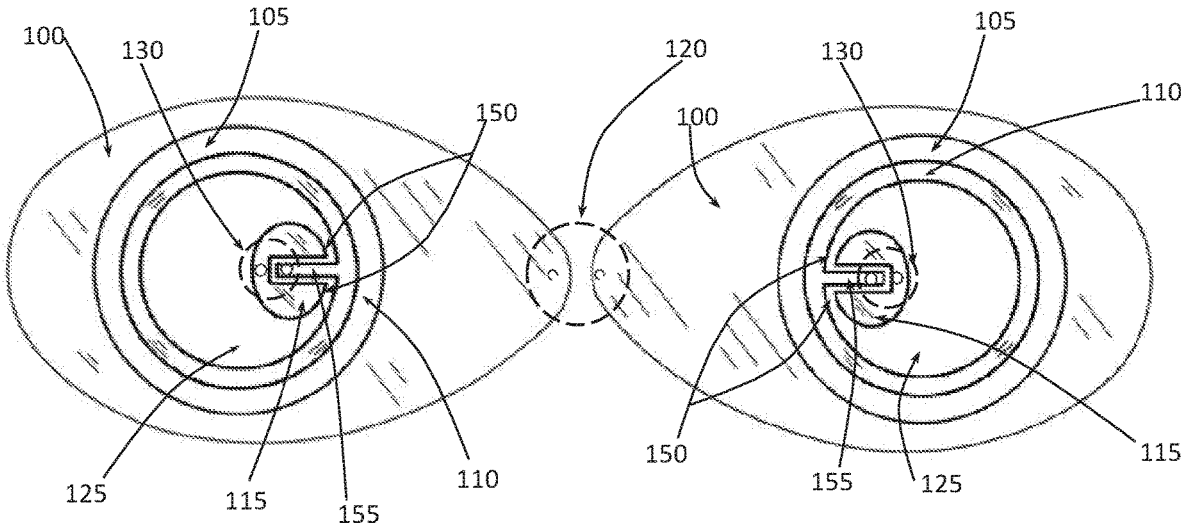
| | |
|---|---|
| 100 | Outer Dipole Antenna Ground (conductor) |
| 105 | De-coupling Gap |
| 110 | Inner Slot Antenna (conductor) |
| 115 | Tuning Element |
| 120 | RF Connector (Outer Antenna Feed) |
| 125 | Slot (hole) |
| 130 | RF Connector at Inner Slot Connector Feed |
| 150 | Slot Gaps |
| 155 | Coplanar Wave Guide Transmission Line |

FIG 3: Decoupled Inner Slot Dual Polarization Monopole Antenna
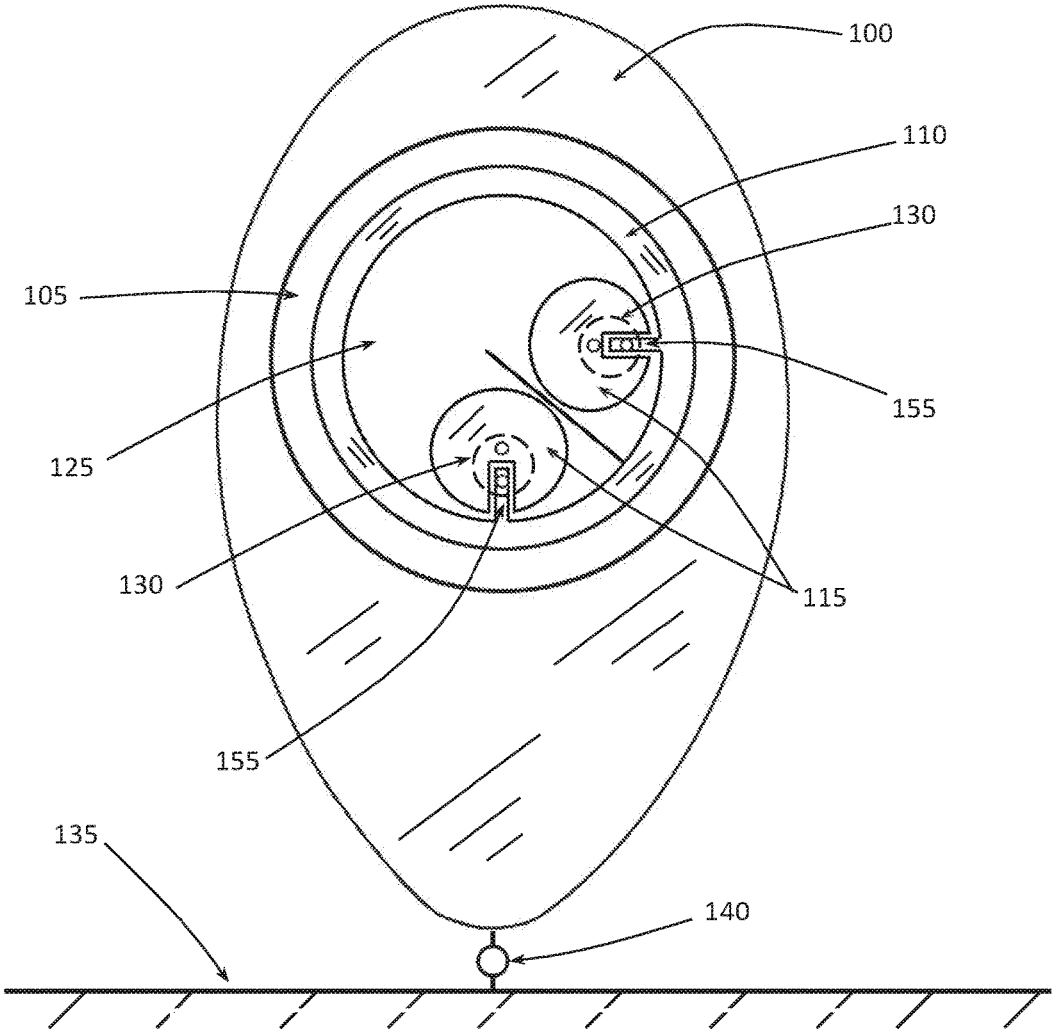
| | |
|---|---|
| 100 | Outer Antenna Ground (conductor) |
| 105 | De-coupling Gap |
| 110 | Inner Antenna Slot (conductor) |
| 115 | Tuning Elements |
| 125 | Slot (hole) |
| 130 | RF Connector at inner Slot antenna feed |
| 135 | Monopole Ground Plane |
| 140 | Monopole Feed (source) |
| 155 | Coplanar Wave Guide Transmission Line |

FIG 4: Decoupled Inner Slot Dual Polarization Dipole Antenna
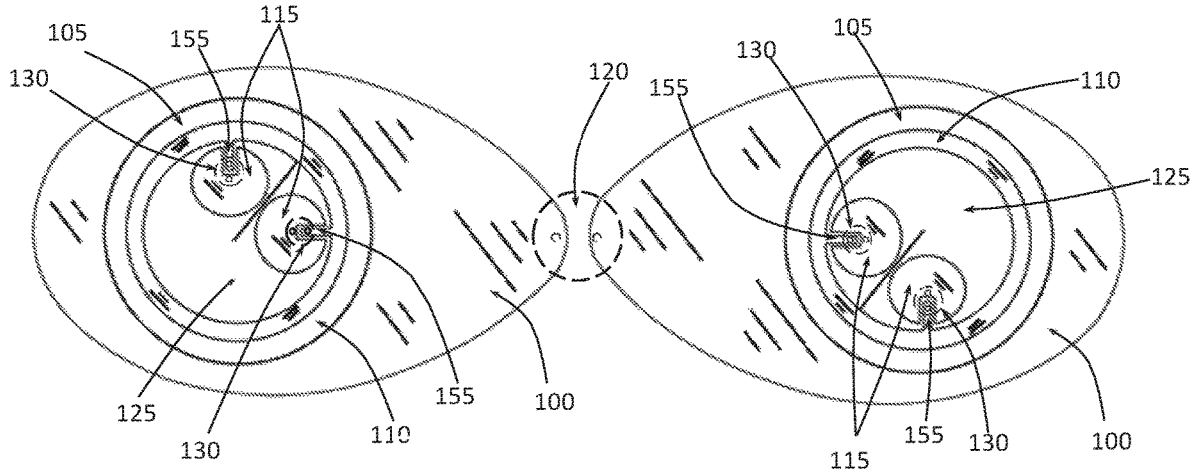
| | |
|---|---|
| 100 | Outer Dipole Antenna Ground (conductor) |
| 105 | De-coupling Gap |
| 110 | Inner Slot Antenna (conductor) |
| 115 | Tuning Elements |
| 120 | RF Connector (Outer Antenna Feed) |
| 125 | Slot (hole) |
| 130 | RF Connector at Inner Slot Connector Feed |
| 155 | Coplanar Wave Guide Transmission Line |

FIG 5: Decoupled Inner Slot Monopole Antenna with Double Slots
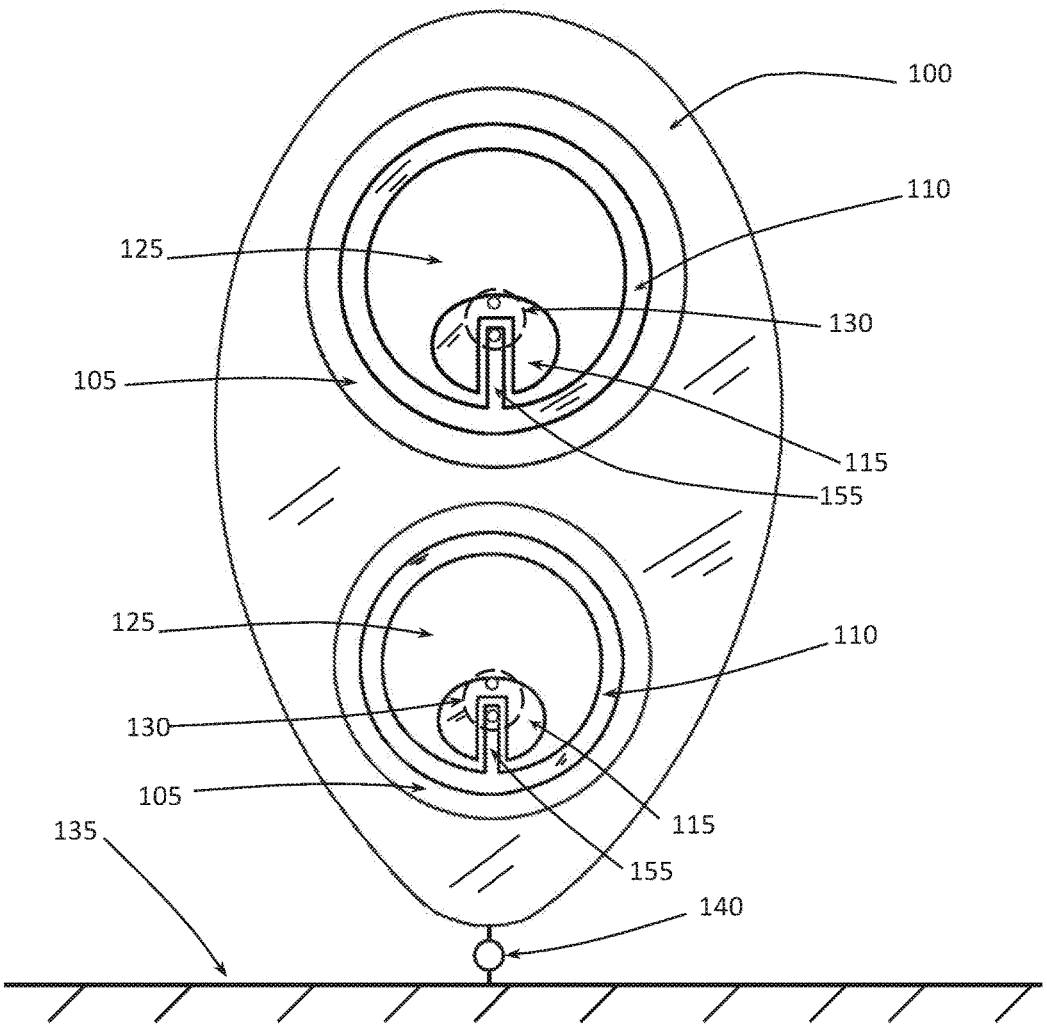
| | |
|---|---|
| 100 | Outer Antenna Ground (conductor) |
| 105 | De-coupling Gap |
| 110 | Inner Antenna Slot (conductor) |
| 115 | Tuning Element |
| 125 | Slot (hole) |
| 130 | RF Connector at Inner Slot antenna feed |
| 135 | Monopole Ground Plane |
| 140 | Monopole Feed (source) |
| 155 | Coplanar Wave Guide Transmission Line |

FIG 6: Decoupled Inner Slot Dipole Antenna with Double Slots
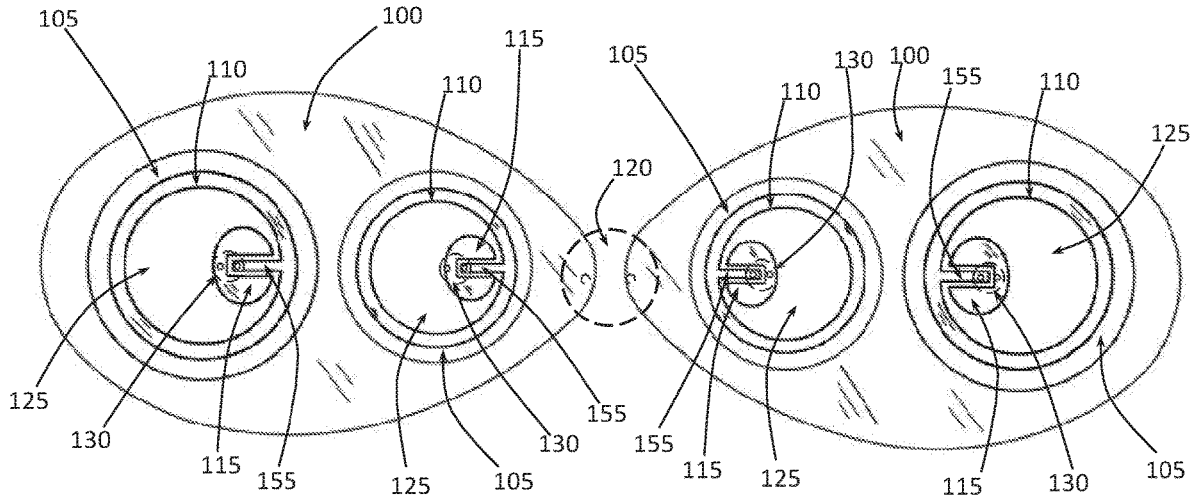
| | |
|---|---|
| 100 | Outer Dipole Antenna Ground (conductor) |
| 105 | De-coupling Gap |
| 110 | Inner Slot Antenna (conductor) |
| 115 | Tuning Elements |
| 120 | RF Connector (Outer Antenna Feed) |
| 125 | Slot (hole) |
| 130 | RF Connector at Inner Slot Connector Feed |
| 155 | Coplanar Wave Guide Transmission Line |

FIG 7: Decoupled Inner Slot Monopole Antenna with Multiple Slots
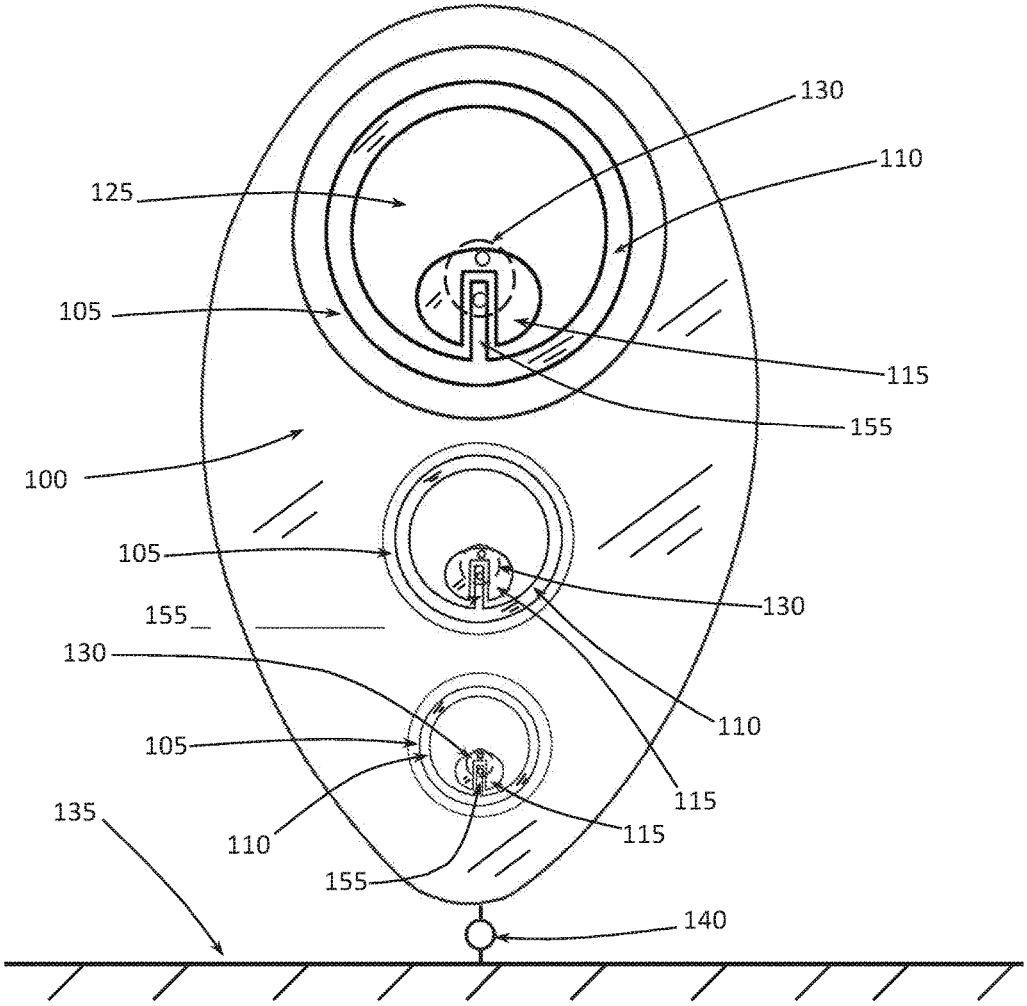
| | |
|---|---|
| 100 | Outer Antenna Ground (conductor) |
| 105 | De-coupling Gap |
| 110 | Inner Antenna Slot (conductor) |
| 115 | Tuning Elements |
| 125 | Slot (hole) |
| 130 | RF Connector at Inner Slot antenna feed |
| 135 | Monopole Ground Plane |
| 140 | Monopole Feed (source) |
| 155 | Coplanar Wave Guide Transmission Line |

FIG 8: Decoupled Inner Slot Dipole Antenna with Multiple Slots
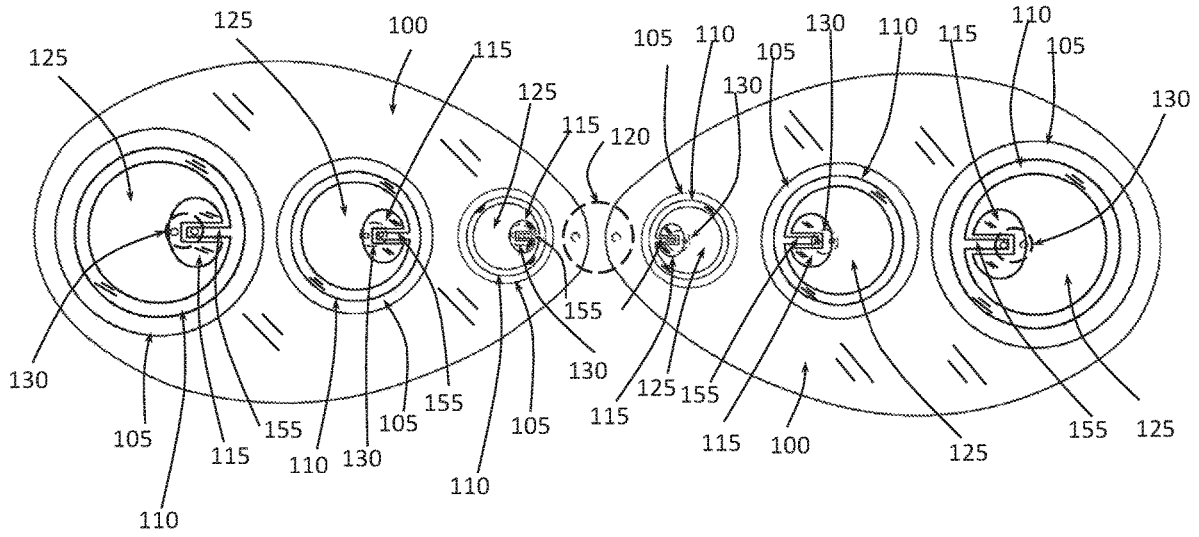
| | |
|---|---|
| 100 | Outer Dipole Antenna Ground (conductor) |
| 105 | De-coupling Gap |
| 110 | Inner Slot Antenna (conductor) |
| 115 | Tuning Elements |
| 120 | RF Connector (Outer Antenna Feed) |
| 125 | Slot (hole) |
| 130 | RF Connector at Inner Slot Connector Feed |
| 155 | Coplanar Wave Guide Transmission Line |

FIG 9: Decoupled Inner Slot Monopole Antenna (square variation)
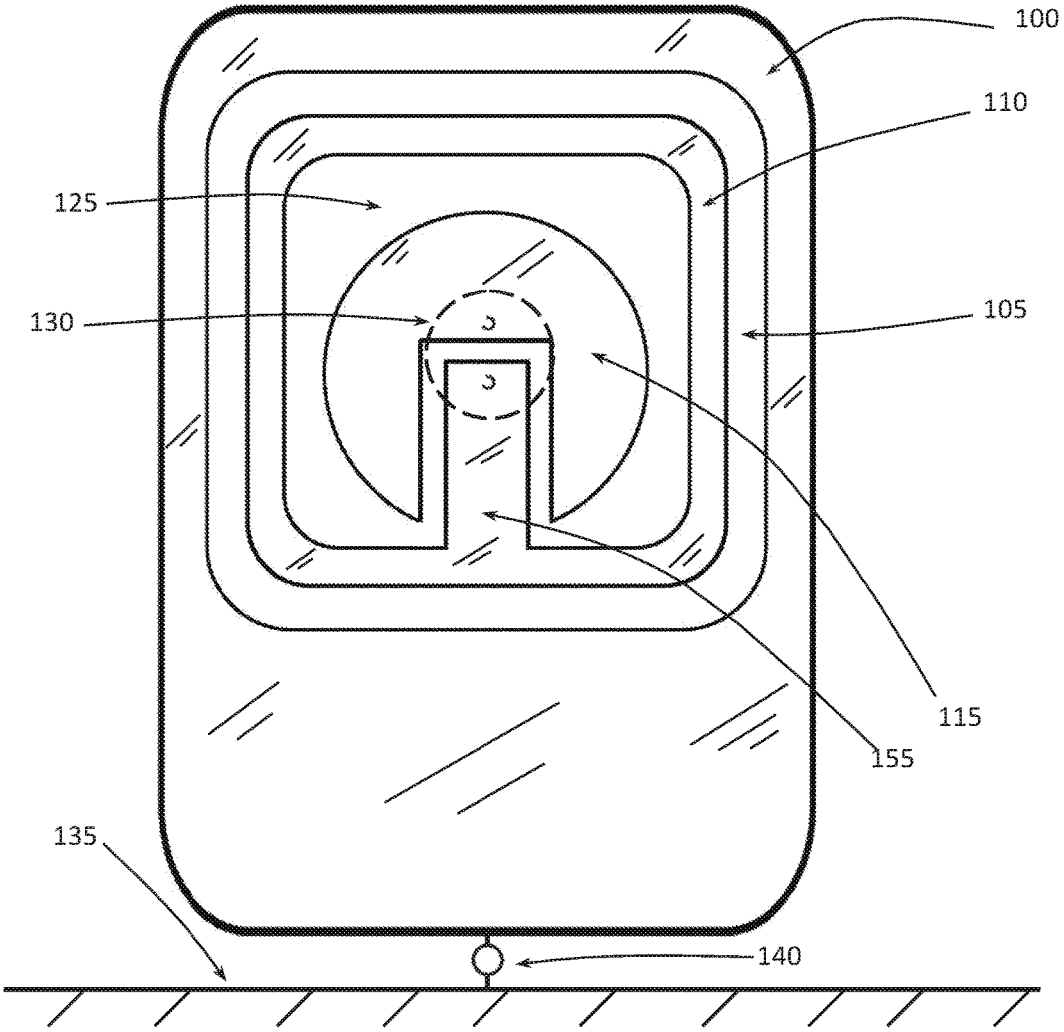
| | |
|---|---|
| 100 | Outer Antenna Ground (conductor) |
| 105 | De-coupling Gap |
| 110 | Inner Antenna Slot (conductor) |
| 115 | Tuning Elements |
| 125 | Slot (hole) |
| 130 | RF Connector at Inner Slot antenna feed |
| 135 | Monopole Ground Plane |
| 140 | Monopole Feed (source) |
| 155 | Coplanar Wave Guide Transmission Line |

FIG 10: Decoupled Inner Slot Dipole Antenna (square variation)
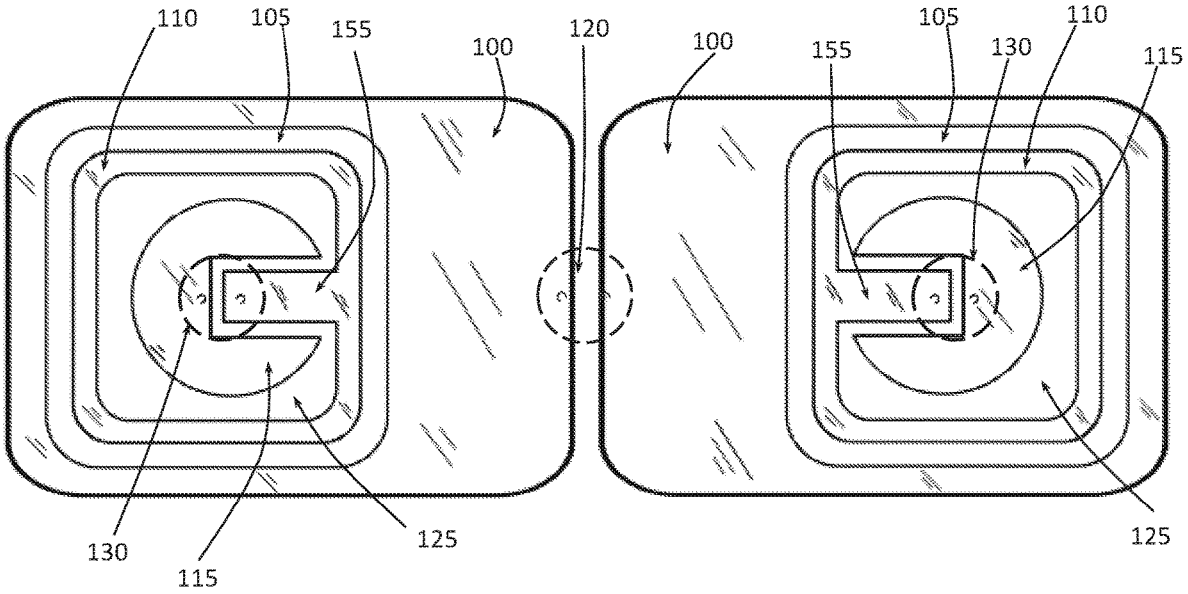
| | |
|---|---|
| 100 | Outer Dipole Antenna Ground (conductor) |
| 105 | De-coupling Gap |
| 110 | Inner Slot Antenna (conductor) |
| 115 | Tuning Elements |
| 120 | RF Connector (Outer Antenna Feed) |
| 125 | Slot (hole) |
| 130 | RF Connector at Inner Slot Connector Feed |
| 155 | Coplanar Wave Guide Transmission Line |

FIG 11: Decoupled Inner Slot Cross Dipole Antenna

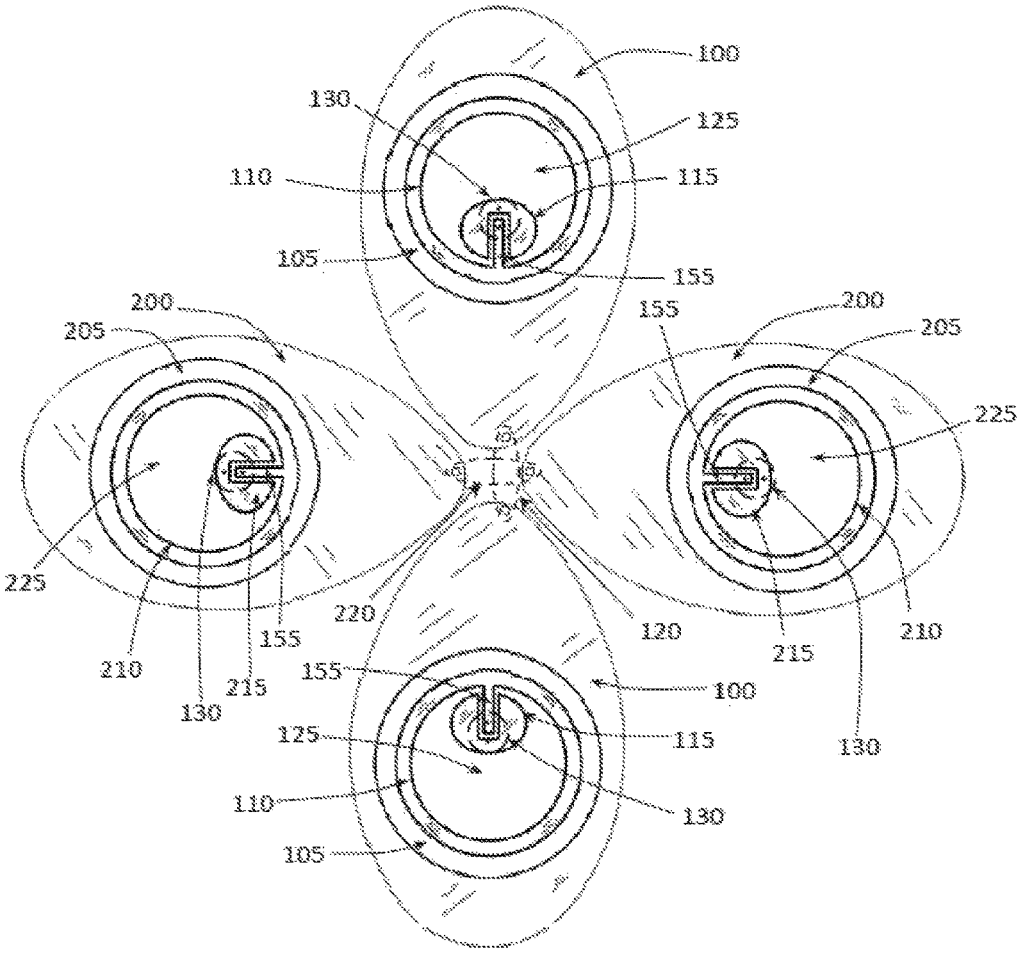

| | |
|---|---|
| 100 | Outer Antenna Ground (conductor) of Dipole #1 |
| 105 | De-coupling Gap of Dipole #1 |
| 110 | Inner Antenna Slot (conductor) of Dipole #1 |
| 115 | Tuning Element of Dipole #1 |
| 120 | RF Connector of Dipole #1 (outer antenna feed) |
| 125 | Slot (hole) of Dipole #1 |
| 130 | RF Connector at Inner Slot of Antenna Feed |
| 155 | Coplanar Wave Guide Transmission Line |
| 200 | Outer Antenna Ground (conductor) of Dipole #2 |
| 205 | De-coupling Gap of Dipole #2 |
| 210 | Inner Antenna Slot (conductor) of Dipole #2 |
| 215 | Tuning Element of Dipole #2 |
| 220 | RF Connector of Dipole #2 (outer antenna feed) |
| 225 | Slot (hole) of Dipole #2 |

FIG 12: Decoupled Inner Slot Antenna with Double Slots on a Cross Dipole

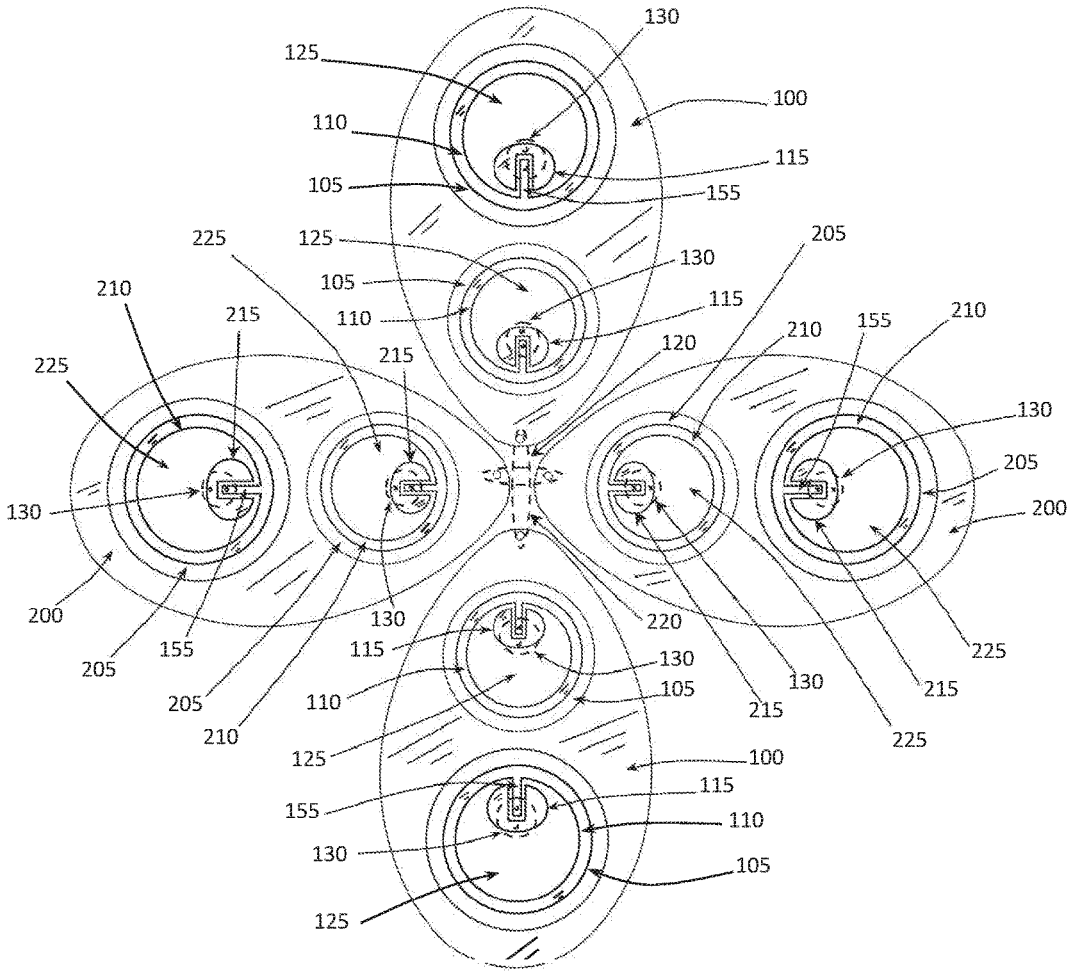

| | |
|---|---|
| 100 | Outer Antenna Ground (conductor) of Dipole #1 |
| 105 | De-coupling Gap of Dipole #1 |
| 110 | Inner Antenna Slot (conductor) of Dipole #1 |
| 115 | Tuning Element of Dipole #1 |
| 120 | RF Connector of Dipole #1 (outer antenna feed) |
| 125 | Slot (hole) of Dipole #1 |
| 130 | RF Connector at Inner Slot of Antenna Feed |
| 155 | Coplanar Wave Guide Transmission Line |
| 200 | Outer Antenna Ground (conductor) of Dipole #2 |
| 205 | De-coupling Gap of Dipole #2 |
| 210 | Inner Antenna Slot (conductor) of Dipole #2 |
| 215 | Tuning Element of Dipole #2 |
| 220 | RF Connector of Dipole #2 (outer antenna feed) |
| 225 | Slot (hole) of Dipole #2 |

FIG 13: Decoupled Inner Slot Dual Polarization on a Cross Dipole

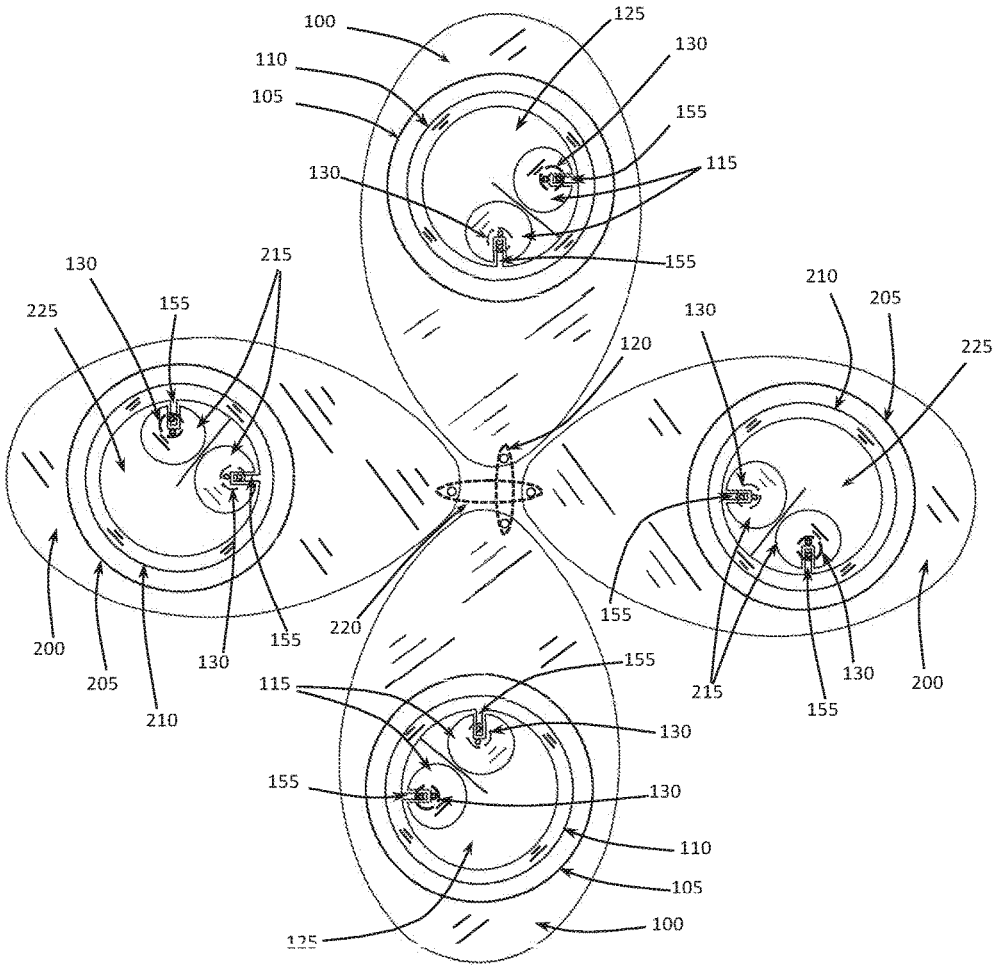

| | |
|---|---|
| 100 | Outer Antenna Ground (conductor) of Dipole #1 |
| 105 | De-coupling Gap of Dipole #1 |
| 110 | Inner Antenna Slot (conductor) of Dipole #1 |
| 115 | Tuning Elements of Dipole #1 |
| 120 | RF Connector of Dipole #1 (outer antenna feed) |
| 125 | Slot (hole) of Dipole #1 |
| 130 | RF Connector at Inner Slot of Antenna Feed |
| 155 | Coplanar Wave Guide Transmission Line |
| 200 | Outer Antenna Ground (conductor) of Dipole #2 |
| 205 | De-coupling Gap of Dipole #2 |
| 210 | Inner Antenna Slot (conductor) of Dipole #2 |
| 215 | Tuning Elements of Dipole #2 |
| 220 | RF Connector of Dipole #2 (outer antenna feed) |
| 225 | Slot (hole) of Dipole #2 |

FIG 14: Additional Dual Pole Variant Examples
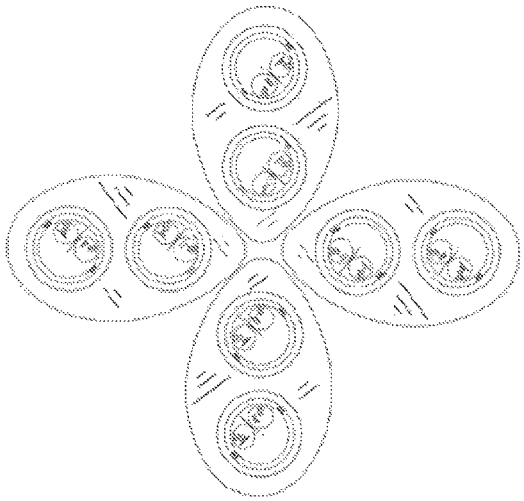
300
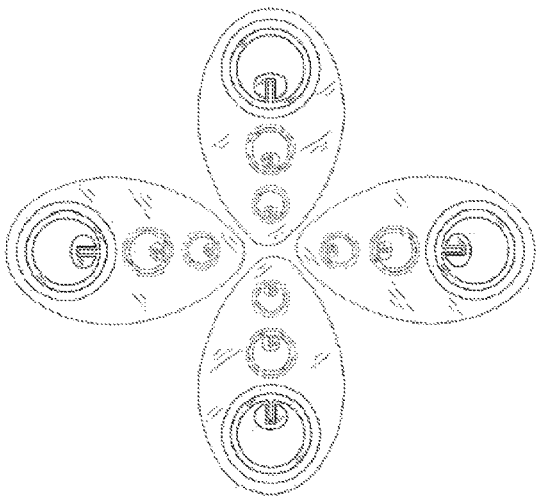
400
| | |
|---|---|
| 300 | Dual Pole variant of Figure 13 |
| 400 | Dual Pole version of Figure 8 |

FIG 15: Return Loss Example of Decoupled Inner Slot Antenna
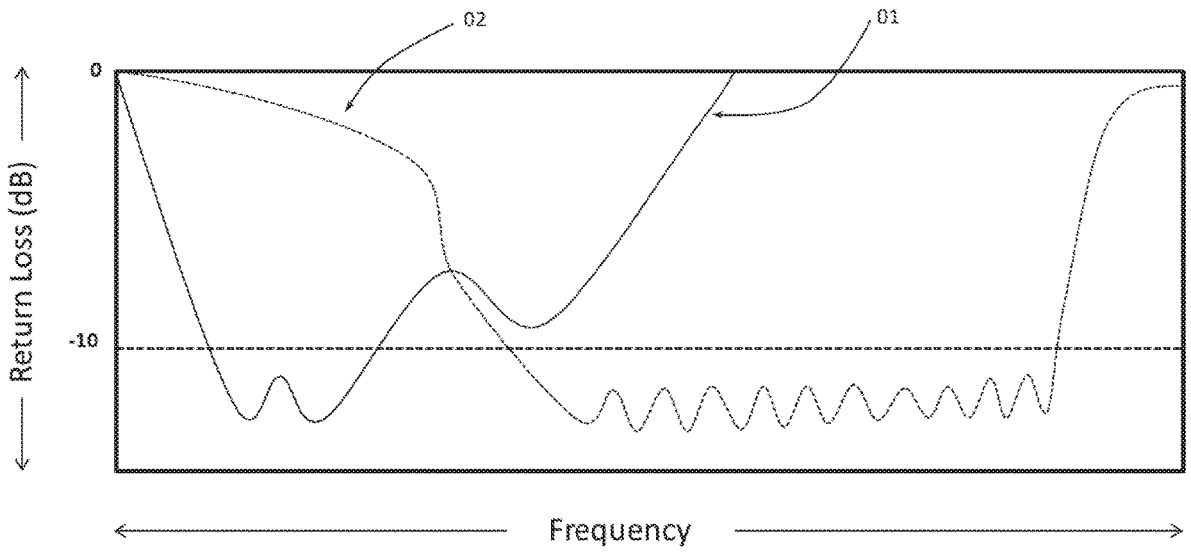
| | |
|---|---|
| 01 | Outer Antenna Return Loss vs. Frequency |
| 02 | Inner Antenna Return Loss vs. Frequency |

DECOUPLED INNER SLOT ANTENNA

NON-PROVISIONAL APPLICATION FOR UNITED STATES PATENT

The present application claims priority to the earlier filed provisional application having Ser. No. 62/754,917, and hereby incorporates subject matter of the provisional application in its entirety.

BACKGROUND

In the design of phased array antennas, as well as simple case of compact antennas, there is a strong interest to locate higher frequency antennas closer in spacing, and/or on the same surface or within the same conductor area as the lower frequency antennas. One means to do this is contained within the technology of Tightly Coupled Dipole Antennas (or TCDAs). The TCDA technology boasts of operational frequency ranges of up to 100:1 of ratio bandwidth, and the ability to reduce grating lobes at nearly any frequency in the 100:1 ratio bandwidth. However, a drawback of this antenna structure is the requirement for an extremely large number of RF ports.

Use of Vivaldi arrays has seen some success, but with much lower bandwidths, on the order of 5:1 to 8:1. However, even at 5:1, as the operational frequency increases, grating lobes increase. Additionally, Vivaldi arrays are often very deep and consume large volumes, which make Vivaldi arrays unsuitable for airborne use.

What is needed is an array antenna technology that can be conformal, and can interleave elements, as the frequency increases, to reduce array grating lobes. Finally, the desired solution would have much fewer required RF antenna ports, than the TCDA solution.

BRIEF SUMMARY OF THE INVENTION

A solution to the TCDA dilemma is in containing wideband Slot Antennas, within the physical area of a larger electric dipole Antenna or Cross Dipole Antenna. There are many antenna designs and concepts, which put a slot or other resonant (or parasitic structure) next to, or even within, an antenna. However, putting a simple structure, such as a rectangular or circular slot (hole), simply changes the performance of the single outer antenna. This innovation puts a Wideband Slot Antenna structure, with a De-Coupling gap around the Slot Ground Plane (or conductor) and isolates the Wideband Slot Antenna (the inner antenna) from the larger Dipole or Monopole antenna leg(s) (the Outer Antenna) and creates a true antenna within an antenna. Both antennas have independent feeds and independent transmission line(s). Two key innovations here are the use of a De-Coupling gap, and the "Compact single pole wideband slot antenna design with inverted co-planar waveguide feed" (Provisional Patent application No. 62/744,995). Therefore, both the Inner Slot Antenna and its CPW feed are independent and isolated from the Outer Antenna and its corresponding feed and transmission line. This structure, which could have a multiplicity of inner Slot Antennas, with numerous RF ports, is very different from the slot (hole only) or parasitic inner structure within a single port antenna system.

BRIEF DESCRIPTION OF THE DRAWINGS

FIG. 1. The illustration in FIG. 1 shows the simplest embodiment of the invention. This is a conventional single antenna leg (100), or monopole antenna, with a single polarization wideband slot antenna (110) within it.

FIG. 2. The illustration in FIG. 2 shows another embodiment of the invention. This is a conventional dipole antenna (100), comprising two legs, with a single polarization wideband slot antenna (110) within each leg.

FIG. 3. The illustration in FIG. 3 shows another embodiment of the innovation. In this embodiment, there are two independent Tuning Elements (115), and associated CPW feeds (155) within the Single Wideband Slot conductor (110).

FIG. 4. The illustration in FIG. 4 shows another embodiment of the innovation. In this embodiment, there are two independent Tuning Elements (115), and associated CPW feeds (155) within each Single Wideband Slot conductor (110).

FIG. 5. In this embodiment (FIG. 5), there are two independent Inner Slot Antenna. Structures or conductors (110), each with their associated Tuning Element (115) and CPW (155).

FIG. 6. The illustration in FIG. 6 shows two independent Inner Slot Antenna Structures or conductors (110), each with their associated. Tuning Element (115) and CPW (155), within each outer Dipole (100) leg.

FIG. 7. The illustration in FIG. 7 shows three independent Inner Slot Antenna Structures or conductors (110), each with their associated Tuning Element (115) and CPW (155), within a single leg, or Monopole structure.

FIG. 8. The illustration in FIG. 8 shows three independent Inner Slot Antenna Structures or conductors (110), each with their associated Tuning Element (115) and CPW (155), within each outer Dipole (100) leg.

FIG. 9. The illustration in FIG. 9 shows an Outer Monopole Antenna Leg (100), as well as Inner Slot Conductor as being square or rectangular.

FIG. 10. The illustration in FIG. 10 shows the Outer Dipole Antenna (100) legs, as well as Inner Slot Conductors as being square or rectangular.

FIG. 11. The illustration in FIG. 11 shows a dual polarization (or cross polarization) Dipole antenna structure with a Single Polarization Wideband Slot Antenna structure (110) within each of the four legs of the cross dipole.

FIG. 12. The illustration in FIG. 12 shows a Dual polarization (or Cross Polarization) Outer Dipole Antennas (leg) (100), with two independent Inner Slot Antenna Structures or conductors (110), each with their associated Tuning Element (115) and CPW (155), within each outer Dipole (100) leg.

FIG. 13. The illustration in FIG. 13 shows a Dual Polarization (or Cross Polarization) Outer Antenna with two independent Tuning Elements (115), and associated CPW feeds (155) within each Single Wideband Slot conductor (110).

FIG. 14. The illustrations in FIG. 14 show embodiments for other variants of the Dual Polarization (or Cross Polarization) Outer Antenna (100) with Inner Slot Antennas (110).

FIG. 15. The illustration in FIG. 15 shows the Return Loss versus Frequency response for the various embodiments.

DETAILED DESCRIPTION AND BEST MODE OF IMPLEMENTATION

The illustration in FIG. 1 shows the simplest embodiment of the invention. This is a conventional single antenna leg (100), or monopole antenna, with a single polarization wideband slot antenna (110) within it. This slot antenna is Dr. Judd's patent pending "Compact Single Pole Wideband Slot Antenna Design with inverted Co-Planar Waveguide Feed", U.S. application 62/744,955. The monopole antenna's ground system (135) provides the return path for RF current, from the Outer Monopole Antenna leg (100) radiation. A De-Coupling Gap (105) isolates the monopole antenna structure (100) from the Inner Antenna slot conductor (110) and Slot antenna Tuning Element (115). Therefore, the outer antenna or monopole and the inner slot antenna (110) are two completely independent and uncoupled structures. Of course, there will some minor amount of RF coupling between these two different structures, but one of the ultimate goals is to reduce the amount of mutual coupling between these two structures (100) and (110). One such method is to increase the size or thickness of the De-Coupling Gap (105). Each separate antenna structure (100) and (110) each have their own independent feed system, (140) and (130), comprised of a connection to an independent RF transmission line or even directly to an RF source. The RF Electric fields for the Outer Monopole antenna (100) radiate out from the top (single leg) of this antenna. However, the RF Electric Field generated from the inner Slot Antenna (110) is generated between the Inner Antenna Slot Conductor (110) and the Tuning Element (115), in the narrow Slot Gap (150) between the two (110 & 115). In this configuration, with the Tuning Element (115) at the bottom of Slot Structure (110), or nearest to the Outer Monopole Antenna Feed (140), the inner slot antenna structures will have Electric Field Polarization in the same axis; in this case parallel to the long axis of the Monopole antenna (100). However, if the Inner Slot conductor (110), Coplanar Waveguide Transmission Line (155) and Tuning Element (155) were rotated 90 degrees, in either rotation direction, relative to the center of the slot (125), then the Outer Monopole Antenna (100) would have polarization orthogonal to the Inner Slot Antenna Structure (110).

The Tuning Element (115) is fed via a Coplanar Waveguide (CPW) transmission line (155), which is inverted and within the Inner Slot Antenna Conductor inner diameter. This slot antenna is Dr. Judd's patent pending "Compact Single Pole Wideband Slot Antenna Design with inverted Co-Planar Waveguide Feed", U.S. application 62/744,955. This solution, not only provides Slot Antenna compactness, but also helps to overcome RF coupling issues between the two structures (100 and 110). The Coplanar Waveguide transmission line (155) is connected to the Inner Antenna Slot Conductor (110) on one side, and to the RF connector/connection (130) at the other end.

This innovation enables the complete dual antenna structure to exist on a single layer of conductor or metal.

The Monopole Antenna (100) is most resonant when its height is roughly a quarter wavelength. However, the Slot antenna is most resonant when the inner diameter of the slot conductor (110) is a half wavelength. Therefore, in this embodiment, it is possible that the Outer Monopole (100) and Inner Slot antenna (110) conductor inner diameter could be resonant at the same frequency. This would occur when the Outer Monopole leg (100) height (or length on the long axis) is roughly twice the inner diameter of the Inner Slot conductor (110).

If the Slot antenna (110) is much smaller than half the height (or length) of the Monopole Antenna leg (100), then it will operate at a frequency range higher than that of the Monopole Antenna (100).

This complete system is a two port system, and is different from antenna structures that parasitize the antenna element with inner slots and or parasitic legs, yet still only have a single RF port which is connected to the antenna structure, or the whole antenna system.

The illustration in FIG. 2 shows another embodiment of the invention. This is a conventional dipole antenna (100), comprising two legs, with a single polarization wideband slot antenna (110) within each leg. There is no requirement that an inner wideband slot antenna must be in each leg, and there could be another embodiment (not shown) where one leg has an inner wideband slot antenna within it, and the other does not. A De-Coupling Gap (105) isolates each dipole antenna leg structure (100) from the Inner Antenna slot conductor (110) and Slot antenna Tuning Element (115). Therefore, the outer antenna dipole structure and the two inner slot antennas (110) are three completely independent and uncoupled antenna structures. Of course, there will some minor amount of RF coupling between these three different structures, but one of the ultimate goals is to reduce the amount of mutual coupling between these three antenna structures, the outer dipole antenna (100) and the two slot antennas (110). One such method is to increase the size or thickness of the De-Coupling Gaps (105). Each separate antenna structure (100) and (110) has their own independent feed system, (120) and (130), comprised of a connection to an independent RF transmission line or even directly to an RF source. The RF Electric fields for the Outer Dipole antenna (100) radiate out from the ends, of each leg (100) of this antenna. However, the RF Electric Field generated from the Inner Slot Antennas (110) is generated between the Inner Antenna Slot Conductor (110) and the Tuning Element (115), in the narrow Slot Gap (150) between the two (110 & 115).

In this configuration, with the Tuning Elements (115), nearest to the Outer Dipole Antenna Feed (120), both slot antenna structures will have Electric Field Polarization in the same axis as the Dipole Antenna (100); in this case parallel to the long axis of the Outer Dipole antenna (100). However, if the Inner Slot conductors (110), Coplanar Waveguide Transmission Lines (155) and Tuning Elements (155) were rotated 90 degrees, in either rotation direction, relative to the center of the slot (125), then the Outer Dipole Antenna would have polarization orthogonal to the Inner Slot Antenna Structures (110). Additionally, another embodiment (not shown) could have one Inner Slot Antenna structure (110 and 115) rotated at 90 degrees, having a polarization orthogonal to the Outer Dipole Antennas Electric Field, and one Inner Slot Antenna structure (110 and 115) not rotated, with Electric Field polarization parallel to the long axis of the Outer Dipole Antenna (100) structure.

Again, each Tuning Element (115) is fed via a CoPlanar Waveguide (CPW) transmission line (155), which is inverted and within the Inner Slot Antenna Conductor inner diameter. This solution, which not only provides Slot Antenna compactness, also helps to overcome RF coupling issues between the two structures (100 and 110). The Coplanar Waveguide transmission line (155) is connected to the Inner Antenna Slot Conductor (110) on one side, and to the RF connector/connection (130) at the other end.

This innovation enables the complete triple antenna structure to exist on a single layer of conductor or metal.

The Outer Dipole Antenna (100) is most resonant when its total length, along the long axis, is roughly a half wavelength. Each Slot antenna is most resonant when the inner diameter of the slot conductor (110) is a half wavelength.

Therefore, in this embodiment, the Outer Dipole Antenna (100) will be much larger than any inner diameter of any Inner Slot antenna (110) conductor. This results in the full operational frequency band of each Inner Wideband Slot antenna (110) being higher than the operational frequency band of the Outer Dipole Antenna (100).

This complete system is a three port system, and is different from antenna structures that parasitize the antenna element with inner slots and or parasitic legs, yet still only have a single RF port which is connected to the antenna structure, or the whole antenna system.

The illustration in FIG. 3 shows another embodiment of the innovation. This is similar to the structure of FIG. 1, that of the Single polarization Outer Monopole Antenna (leg) (100), over a ground plane (135) with a single polarization Wideband Inner Slot antenna (100) with a single Tuning Element (155). However, in this embodiment (FIG. 3), there are two independent Tuning Elements (115), and associated CPW feeds (155) within the Single Wideband Slot conductor (110). In this figure, the two CPW feeds, and Tuning Elements are rotated 90 degrees from one another and independently produce unique and cross polarized Electric Fields, in the Far Field.

This complete system is a three port system, and is different from antenna structures that parasitize the antenna element(s) with inner slots and or parasitic legs, yet still only have a single RF port connected to the outer antenna structure.

Each Tuning Element (115) can be different, in size and frequency coverage.

Tuning Elements (115) do not have to be positioned 90 degrees rotated from each other. However, other than perfect 90 degrees rotation from one another will generate higher coupling between these two independent antenna structures.

The illustration in FIG. 4 shows another embodiment of the innovation. This is similar to the structure of FIG. 2, that of the Single polarization Outer Dipole Antenna (leg) (100), with a single polarization Wideband Inner Slot antenna (100) with a single Tuning Element (155) within each leg. However, in this embodiment (FIG. 4), there are two independent Tuning Elements (115), and associated CPW feeds (155) within each Single Wideband Slot conductor (110). In this figure, the two CPW feeds for each Wideband Slot Antenna Structure (110) and Tuning Elements (115) are rotated 90 degrees from one another and independently produce unique and cross polarized Electric Fields in the Far Field.

This complete system is a five port system, and is different from antenna structures that parasitize the antenna element(s) with inner slots and or parasitic legs, yet still only have a single RF port connected to the outer antenna structure, or the whole antenna system. For this innovation, one port goes to each Tuning Element (115), comprising four total parts, and the fifth port is the feed for the Outer Dipole Antenna (120).

Each Tuning Element (115) can be different, in size and frequency coverage.

Tuning Elements (115) within each slot conductor (110) do not have to be positioned 90 degrees rotated from each other. However, other than perfect 90 degrees rotation from one another will generate higher coupling between these two independent antenna structures.

The illustration in FIG. 5 shows another embodiment of the innovation. This is similar to the structure of FIG. 1, that of the Single polarization Outer Monopole Antenna (leg) (100), over a ground plane (135) with a single polarization Wideband Inner Slot antenna (100) with a single Tuning Element (155).

However, in this embodiment (FIG. 5), there are two independent Inner Slot Antenna Structures or conductors (110), each with their associated Tuning Element (115) and CPW (155). In this embodiment, the two Inner Slot Antennas (110) are shown above/below each other. However, in general, as long as there is sufficient Outer Antenna Leg (100) area, the two Inner Slot Antenna structures (100) can be at any relative position and/or orientation to each other.

Slot Antenna Structures, within a given leg, can also share De-Coupling Gaps (105). That is, their De-Coupling gaps (105) can overlap each other (not shown) as long as the Inner Slot Antenna Conductors (110) are not overlapping each other.

In this figure, the two CPW feeds (155), and Tuning Elements (115) are aligned with each other, such that all three antenna structures: the Outer Monopole Single Leg Antenna, and the two Inner Wideband Slot Antennas, all produce Far Field Electric fields that are all in the same polarization. Other embodiments (not shown) would allow any orientation or rotation angle of the Tuning Elements (115) and associated CPW feed (155) within each or either Inner Slot Structure (110). Therefore, Tuning Elements (115) do not have to be aligned, or zero degrees rotated from each other.

This complete system is a three port system, and is different from antenna structures that parasitize the antenna element(s) with inner slots and or parasitic legs, yet still only have a single RF port connected to the outer antenna structure, or the whole antenna system.

Each Tuning Element (115) can be different, in size and frequency coverage.

The illustration in FIG. 6 shows another embodiment of the innovation. This is similar to the structure of FIG. 2, that of the Single polarization Outer Dipole Antenna (leg) (100), with a single polarization Wideband Inner Slot antenna (100) with a single Tuning Element (155) within each leg.

However, in this embodiment (FIG. 6), there are two independent inner Slot Antenna Structures or conductors (110), each with their associated Tuning Element (115) and CPW (155), within each outer Dipole (100) leg. In this embodiment, the four Inner Slot Antennas (110) are shown all aligned with each other, sharing a common axis. However, in general, as long as there is sufficient Outer Antenna Leg (100) area, the four Inner Slot Antenna structures (110) can be at any relative position and/or orientation to each other.

Slot Antenna Structures (110), within a given leg, can also share De-Coupling Gaps (105). That is, their De-Coupling gaps (105) can overlap each other (not shown) as long as the Inner Slot Antenna Conductors (110) are not overlapping each other.

In this figure, the four CPW feeds (155), and Tuning Elements (115) are aligned with each other, such that all five antenna structures: the Outer Dipole (dual leg) Antenna, and the four Inner Wideband Slot Antennas, all produce Far Field Electric fields that a e all in the same polarization. Other embodiments (not shown) would allow any orientation or rotation angle of the Tuning Elements (115) and associated CPW feed (155) within each or either Inner Slot Structure (110). Therefore, Tuning Elements (115) do not have to be aligned, or zero degrees rotated from each other.

This complete system is a five port system, and is different from antenna structures that parasitize the antenna element(s) with inner slots and or parasitic legs, still only have a single RF port connected to the outer antenna structure, or the whole antenna system.

Each Tuning Element (115) can be different, in size and frequency coverage.

The illustration in FIG. 7 shows another embodiment of the innovation. This is similar to the structure of FIG. 1, that of the Single polarization Outer Monopole Antenna (leg) (100), over a ground plane (135) with a single polarization Wideband Inner Slot antenna (100) with a single Tuning Element (155), and also to the embodiment in FIG. 5.

However, in this embodiment (FIG. 7), there are three independent Inner Slot Antenna Structures or conductors (110), each with their associated Tuning Element (115) and CPW (155). In this embodiment, the three Inner Slot Antennas (110) are shown above/below each other. However, in general, as long as there is sufficient Outer Antenna Leg (100) area, the three Inner Slot Antenna structures (110) can be at any relative orientation to each other. Further embodiments of this design allow for a multiplicity of Inner Slot Antennas Structures, each with their associated Tuning Element (115) and CPW (155), as long as there is sufficient area within the Outer Monopole Antenna Leg (100). Additionally, both the inner Wideband Antenna Slot conductors (110) and associated Tuning Elements (115) can be of different size and shape, such that they form not only independent antennas but cover different frequency bands from each other as well as the Outer Monopole Antenna (100).

Slot Antenna Structures (110), within a given leg, can also share De-Coupling Gaps (105). That is, their De-Coupling gaps (105) can overlap each other (not shown) as long as the Inner Slot Antenna Conductors (110) are not overlapping each other.

In this figure, the three CPW feeds (155), and Tuning Elements (115) are aligned with each other, such that all four antenna structures: the Outer Monopole Single Leg Antenna, and the three Inner Wideband Slot Antennas, all produce Far Field Electric fields that are all in the same polarization. Other embodiments (not shown) would allow any orientation or rotation angle of the Tuning Elements (115) and associated CPW feed (155) within each or either Inner Slot Structure (110). Therefore, Tuning Elements (115) do not have to be aligned, or zero degrees rotated from each other.

This complete system is a four port system, and is different from antenna structures that parasitize the antenna element(s) with inner slots and or parasitic legs, yet still only have a single RF port connected to the outer antenna structure, or the whole antenna system.

Each Tuning Element (115) can be different, in size and frequency coverage.

The illustration in FIG. 8 shows another embodiment of the innovation. This is similar to the structure of FIG. 6, which is the Single polarization Outer Dipole Antenna (leg) (100), with two single polarization Wideband Inner Slot antennas (110), each with their associated single Tuning Element (155) within each leg. However, in this embodiment (FIG. 8), there are three independent Inner Slot Antenna Structures or conductors (110), each with their associated Tuning Element (115) and CPW (155), within each outer Dipole (100) leg. Further embodiments of this design allow for a multiplicity of Inner Slot Antennas Structures, each with their associated Tuning Element (115) and CPW (155), as long as there is sufficient area within the Outer Dipole Antenna Legs (100).

In this embodiment, the six (6) Inner Slot Antennas (110) are shown all aligned with each other, sharing a common axis. However, in general, as long as there is sufficient Outer Antenna Leg (100) area, the six Inner Slot Antenna structures (110) can be at any relative position and/or orientation to each other. Slot Antenna. Structures (110), within a given leg, can also share De-Coupling Gaps (105). That is, their De-Coupling gaps (105) can overlap each other (not shown) as long as the Inner Slot Antenna Conductors (110) are not overlapping each other.

Additionally, both the inner Wideband Antenna. Slot conductors (110) and associated Tuning Elements (115) can be of different size and shape, such that they form not only independent antennas but cover different frequency bands from each other as well as the Outer Dipole Antenna (100).

In this figure, the three CPW feeds (155), and Tuning Elements (115) are aligned with each other, such that all four antenna structures: the Outer Dipole (dual leg) Antenna, and the three Inner Wideband Slot Antennas, all produce Far Field Electric fields that are all in the same polarization. Other embodiments (not shown) would allow any orientation or rotation angle of the Tuning Elements (115) and associated CPW feed (155) within each or either Inner Slot Structure (110). Therefore, Tuning Elements (115) do not have to be aligned, or zero degrees rotated from each other.

This complete system is a seven port system, and is different from antenna structures that parasitize the antenna element(s) with inner slots and or parasitic legs, yet still only have a single RF port connected to the outer antenna structure, or the whole antenna system.

Each Tuning Element (115) can be different, in size and frequency coverage.

The illustration in FIG. 9 shows another embodiment of the innovation. It shows an Outer Monopole Antenna Leg (100), as well as Inner Slot Conductor as being square or rectangular. All other attributes or characteristics are similar to that of FIG. 1. In fact, the Outer Monopole Leg (100) can be of any shape, and the Inner slot structure (110) can be of any shape, with each shape (100 and 110) not having to be similar to one another.

The illustration in FIG. 10 shows another embodiment of the innovation. It shows the Outer Dipole Antenna (100) legs, as well as Inner Slot Conductors as being square or rectangular. All other attributes or characteristics are similar to that of FIG. 2. In fact, the Outer Dipole Antenna Legs (100) can be of any shape, and the Inner slot structures (110) can be of any shape, with each shape (100 and 110) not having to be similar to one another.

The illustration in FIG. 11 shows another embodiment of the innovation. Similar to FIG. 2, it however, shows a dual polarization (or cross polarization) Dipole antenna structure, with four total legs, with a Single Polarization Wideband Slot Antenna structure (110) within each of the four legs of the cross dipole. Note, there is no requirement that an inner wideband slot antenna must be within each and every Dipole leg, and there could be another embodiment (not shown) where one or more legs has an inner wideband slot antenna within it, and one or more does not. A De-Coupling Gap (105 and 205) isolates each dipole antenna leg structure (100 and 200) from the Inner Antenna slot conductor (110 and 210) and Slot antenna Tuning Element (115 and 215), within each leg. Therefore, the two outer dipole antenna structures (100 and 200) and the four inner slot antennas (110 and 210), one in each leg, are six completely independent and uncoupled structures, with an independent RF port to each structure. Of course, there will some minor amount of RF coupling between these six different structures, but one of the ultimate goals is to reduce the amount of mutual coupling between these six structures (100 and 200) and (110 and 210). One such method is to increase the size or thickness of the De-Coupling Gaps (105 and 205). Each separate antenna structure (100 and 200) and (110 and 210)

each have their own independent feed system, (120 and 220) and (130), comprised of a connection to an independent RF transmission line or even directly to an RF source.

For each of the Cross Dipole structures in this configuration, with the Tuning Elements (115 and 215) nearest to the Outer Dipole Antenna Feed (120 and 220) that encapsulates the Slot structure (110 and 210), both slot antenna structures (110 and 210) will have Electric Field Polarization in the same axis; in this case parallel to the long axis of the Outer Dipole antenna (100 and 200) that encapsulates the two slot structures (110 and 210). However, if the Inner Slot conductors (110 and 210), Coplanar Waveguide Transmission Lines (155) and Tuning Elements (115 and 215) were rotated 90 degrees, in either rotation direction, relative to the center of the slot (125 and 225), then the Outer Dipole Antenna encapsulate the slot structures (110 and 210) would have polarization orthogonal to the Inner Slot Antenna Structures (110 and 210). Additionally, another embodiment (not shown) could have one Inner Slot Antenna structure (110 and 115 for the first dipole, and 210 and 215 for the second dipole) rotated at 90 degrees, having a polarization orthogonal to the Outer Dipole Antennas Electric Field, and one Inner Slot Antenna structure (110 and 115 for the first dipole, and 210 and 215 for the second dipole) not rotated, with Electric Field polarization parallel to the long axis of the Outer Dipole Antenna (100 for the first dipole, and 200 for the second dipole) structure.

Again, each Tuning Element (115 and 215) is fed via a Coplanar Waveguide (CPW) transmission line (155), which is inverted and within the Inner Slot Antenna Conductor inner diameter. This solution, which not only provides Slot Antenna compactness, also helps to overcome RF coupling issues between the two structures (100 and 110), within the first Dipole leg pair (200 and 210 for the second Dipole leg pair). The Coplanar Waveguide transmission line (155) is connected to the Inner Antenna Slot Conductor (110 and 210) on one side, and to the RF connector/connection (130) at the other end.

This innovation enables the complete six antenna structure to exist on a single layer of conductor or metal.

The Outer Dipole Antenna (100 and 200) is most resonant when its total length, along the long axis, is roughly a half wavelength. Each Slot antenna is most resonant when the inner diameter of the slot conductor (110 and 210) is a half wavelength.

Therefore, in this embodiment, the Outer Dipole Antennas (100 and 200) will be much larger than any inner diameter of any Inner Slot antenna (110 and 210) conductor. This results in the full operational frequency band of each inner Wideband Slot antenna (110 and 210) being higher than the operational frequency band of the Outer Dipole Antennas (100 and 200).

This complete system is a six port system, and is different from an antenna structures that parasitize the antenna element with inner slots and or parasitic legs, yet still only have a single RF port connected to the antenna structure, or the whole antenna system.

Slot Antenna Structures (110 and 210), within a given leg, can also share De-Coupling Gaps (105 and 205). That is, their De-Coupling gaps (105 and 205) can overlap each other (not shown) as long as the Inner Slot Antenna Conductors (110 and 210) are not overlapping each other.

The illustration in FIG. 12 shows another embodiment of the innovation. This is similar to the structure of FIG. 11, that of the Dual polarization (or Cross Polarization) Outer Dipole Antennas (leg) (100 and 200), with a single polarization Wideband Inner Slot antenna (100 and 200) with a single Tuning Element (155) within each leg.

However, in this embodiment (FIG. 12), there are two independent Inner Slot Antenna Structures or conductors (110 and 210), each with their associated Tuning Element (115 and 215) and CPW (155), within each outer Dipole (100 and 200) leg. In this embodiment, the eight (8) Inner Slot Antennas (110) are shown all aligned with each other, sharing a common axis. However, in general, as long as there is sufficient Outer Antenna Leg (100 and 200) area, the eight Inner Slot Antenna structures (110 and 210) can be at any relative position and/or orientation to each other.

Slot Antenna Structures (110 and 210), within a given leg, can also share De-Coupling Gaps (105 and 205). That is, their De-Coupling gaps (105 and 205) can overlap each other (not shown) as long as the Inner Slot Antenna Conductors (110 and 210) are not overlapping each other.

In this figure, the eight CPW feeds (155), and Tuning Elements (115 and 215) are aligned with each other, such that all ten antenna structures: the two Outer Dipole (dual leg) Antennas, and the eight Inner Wideband Slot Antennas, all produce Far Field Electric fields that are all in the same polarization. Other embodiments (not shown) would allow any orientation or rotation angle of the Tuning Elements (115 and 215) and associated CPW feed (155) within each or either Inner Slot Structure (110 and 210). Therefore, Tuning Elements (115) do not have to be aligned, or zero degrees rotated from each other.

This complete system is a ten port system, and is different from antenna structures that parasitize the antenna element(s) with inner slots and or parasitic legs, yet still only have a single RF port connected to the outer antenna structure, or the whole antenna system.

Each Tuning Element (115 and 215) and each slot conductor (110 and 210) can be different, in size and frequency coverage.

The illustration in FIG. 13 is the Dual Polarization (or Cross Polarization) variant of the Dipole in FIG. 4. In this embodiment (FIG. 13), there is a single Wideband Slot Conductor (110 and 210) within each outer Dipole (100 and 200) leg. Within each Single Wideband Slot conductor (110 and 210), there are two independent, dual polarization Tuning Elements (115 and 215), and two associated CPW feeds (155).

In this figure, the two CPW feeds for each Wideband Slot Antenna Structure (110 and 210) and Tuning Elements (115 and 215) are rotated 90 degrees from one another and independently produce unique and cross polarized Electric Fields in the Far Field. However, in general, these tuning elements (115 and 215) can be in any orientation and rotation or position to one another, for any slot structure (110 or 210). Other embodiments (not shown) would allow any orientation or rotation angle of the Tuning Elements (115 and 215) and associated CPW feed (155) within each or either Inner Slot Structure (110 and 210). Therefore, Tuning Elements (115) do not have to be aligned, or zero degrees rotated from each other.

Slot Antenna Structures (110 and 210), within a given leg, can also share De-Coupling Gaps (105 and 205). That is, their De-Coupling gaps (105 and 205) can overlap each other (not shown) as long as the Inner Slot Antenna Conductors (110 and 210) are not overlapping each other.

This complete system is a ten port system, and is different from antenna structures that parasitize the antenna element(s) with inner slots and or parasitic legs, yet still only have a single RF port connected to the outer antenna structure, or the whole antenna system. One port goes to each of the Dipole's Tuning Elements (115 and 215), comprising eight total parts, and the ninth and tenth ports are the feeds (120 and 220) for the two Outer Dipole Antenna (100 and 200), which together comprise the Dual Polarization (or Cross Polarization) antenna structure.

Each Tuning Element (115 and 215) can be different, in size and frequency coverage.

Tuning Elements (115 and 215) within each slot conductor (110 and 210) do not have to be positioned 90 degrees rotated from each other. However, other than perfect 90 degrees rotation from one another will generate higher coupling between these two independent antenna structures.

The illustrations in FIG. 14 show embodiments for other variants of the Dual Polarization (or Cross Polarization) Outer Antenna (100) with Inner Slot Antennas (110). In these variations, there can be a multiplicity of either/or Single Polarization or Dual Polarization Wideband Slot Antennas, within Outer Dipole Antenna (100) legs. This multiplicity of Inner Slot Antennas (110) can have any number of Inner Slot Antenna Structures (110), which will fit within the area of each leg. Any Outer Dipole (100) leg can also have no Inner Slot Antenna Structures. Any Inner Slot Antenna Structure (110) can be rotated at any angle relative to a common vector, on the plane or conformal surface. Tuning Elements (115) for any Inner Slot Antenna can be rotated at any angle relative to a common vector angle. This includes rotation angles for any diversely polarized Inner Slot Antenna (110).

Each Tuning Element (115) and each slot conductor (110) can be different, in size and frequency coverage.

The illustration in FIG. 15 shows the Return Loss versus Frequency response for the various embodiments. The solid curve (01) would be representative of the Return Loss performance for the Larger or Outer Antenna. The section with Return Loss under −10 dB would be associated with the Outer Antenna best performance in frequency. The dotted curve (02) would be representative of the Return Loss performance for the Inner Slot Antenna, or one of the Inner Slot Antennas. Notice the response would occur at a higher frequency that the Outer antenna, for most cases. The best Return Loss performance region, for this Inner Antenna response (02), could be positioned almost anywhere above the Outer Antenna (01) best performance region simply by scaling the size of the Inner Slot Antenna conductor (110) size or diameter.

REFERENCES (INCORPORATED HEREIN BY REFERENCE)

Judd, Mano D., inventor. Compact Single Pole Wideband Slot Antenna Design with Inverted Co-Planar Waveguide Feed. U.S. provisional patent application 62/744,955. Oct. 12, 2018.

Judd, Mano D., inventor. Dual Polarization Antenna. U.S. patent application Ser. No. 15/210,583. Jul. 14, 2016.

What is claimed is:

1. A dual antenna structure comprising:

an outer antenna which is a conformal electric dipole or a conformal cross dipole antenna;

a feed point or a transmission line for the outer antenna;

an inner antenna comprising a slot which is a conformal narrowband or a wideband slot antenna, wherein the inner antenna is inside the outer antenna;

an inverted co-planar waveguide, which operates as an inner antenna feed line, within an internal radiation structure which are both within the slot of the inner antenna;

a de-coupling gap between the outer antenna and the inner antenna;

wherein the outer antenna and the inner antenna create an antenna-within-an-antenna structure; and wherein the outer antenna, the inner antenna, the internal radiation structure, the inner antenna feedline, and the de-coupling gap are conformal to a single surface.

2. The antenna of claim 1 wherein the outer antenna can be any type of electric or magnetic antenna, such as a dipole, a monopole, a patch, an other metallic antenna or a conductive material antenna.

3. The antenna of claim 1 wherein the inner antenna uses a feed separate from the feed point of the outer antenna.

4. The antenna of claim 1 wherein the de-coupling gap isolates the inner antenna from the outer antenna, and creates the antenna-within-an-antenna structure.

5. The antenna of claim 1 wherein the outer antenna and the feed point are independent of the inner antennas and the inner antenna feed line.

6. The antenna of claim 1 wherein the outer antenna and the inner antennas can have the same polarization or different polarizations.

7. The antenna of claim 1 wherein all metallic or conductive components reside on a single plane or surface, such that all components of the outer antenna and all components of the inner antenna can be considered a single conformal layer.

8. A dual polarized antenna comprising:

A pair of outer electric dipole antennas or a pair of cross dipole antennas;

a pair of inner wideband slot antennas located within the pair of outer electric dipole antennas; and a de-coupling gap between each outer electric dipole antenna and each inner wideband slot antenna; wherein the dual polarized antenna creates an antenna-within-an-antenna structure;

and is conformal to a single surface.

9. The antenna of claim 8 wherein the outer electric dipole antenna can be any type of electric dipole antenna.

10. The antenna of claim 8 wherein the inner wideband slot antenna uses a feed separate from a feed of the outer electric dipole antenna.

11. The antenna of claim 8 wherein the de-coupling gap isolates the inner antennas from the larger outer antenna, and creates an antenna-within-an-antenna structure.

12. The antenna of claim 8 wherein both the outer electric dipole antennas and the inner wideband slot antennas have independent feeds and independent transmission lines to their feeds.

13. The antenna of claim 8 wherein the outer electric dipole antennas and the inner wideband slot antennas can have the same polarization or different polarizations.

14. The dual polarized antenna of claim 8 wherein all metallic or conductive components reside on a single plane or surface, such that all components of the dual polarized antenna can be considered be a single layer structure.

* * * * *